US008915498B2

(12) United States Patent
Hynds

(10) Patent No.: US 8,915,498 B2
(45) Date of Patent: Dec. 23, 2014

(54) CORNHOLE GAME DIFFICULTY MODIFICATION

(71) Applicant: William B. Hynds, Columbia, SC (US)

(72) Inventor: William B. Hynds, Columbia, SC (US)

( * ) Notice: Subject to any disclaimer, the term of this patent is extended or adjusted under 35 U.S.C. 154(b) by 0 days.

(21) Appl. No.: 14/176,066

(22) Filed: Feb. 8, 2014

(65) Prior Publication Data

US 2014/0333026 A1 Nov. 13, 2014

Related U.S. Application Data

(60) Provisional application No. 61/855,300, filed on May 13, 2013, provisional application No. 61/959,407, filed on Aug. 23, 2013.

(51) Int. Cl.
*A63B 5/06* (2006.01)
*A63B 63/00* (2006.01)
*A63B 67/06* (2006.01)

(52) U.S. Cl.
CPC ..... *A63B 67/06* (2013.01)
USPC ..... 273/381; 273/354; 273/402

(58) Field of Classification Search
CPC ..... A63B 57/06; A63B 63/00; A63B 63/003; A63B 2063/002; A63B 69/3676; A63B 67/06; A63B 2024/0037; A63B 24/0021; A63B 2071/0625; A63F 9/0204
USPC ..... 473/179, 190–192; 273/381, 382, 354, 273/398–402, 390–392

See application file for complete search history.

(56) References Cited

U.S. PATENT DOCUMENTS

| | | | | | |
|---|---|---|---|---|---|
| 1,184,822 | A * | 5/1916 | Caplette | 473/515 |
| 3,511,506 | A * | 5/1970 | Schollick | 473/184 |
| 4,660,834 | A * | 4/1987 | Carrigan | 473/165 |
| 5,242,169 | A * | 9/1993 | Laabs et al. | 473/184 |
| 5,478,071 | A * | 12/1995 | Barrs et al. | 473/176 |
| 5,765,832 | A * | 6/1998 | Huff | 273/354 |
| 6,244,598 | B1 * | 6/2001 | Conville | 273/402 |
| D624,982 | S * | 10/2010 | Perusa | D21/789 |
| 7,909,329 | B1 * | 3/2011 | Martinson | 273/330 |
| 2007/0099716 | A1 * | 5/2007 | Du Plessis | 473/179 |

* cited by examiner

*Primary Examiner* — Mark Graham
(74) *Attorney, Agent, or Firm* — Melissa B. Neely

(57) ABSTRACT

The invention is a device that modifies the target aperture for the standard game board for the traditional lawn game known as cornhole or bean bag toss. The device, when inserted into the game board's target aperture, replaces the open hole with a circular shaped "trapdoor" that opens only when directly struck by a tossed game bag. When opened, the trapdoor allows the passage of the game bag through the game boards target aperture. The device includes a spring hinge mechanism that returns the trapdoor to the closed position after the bag has passed through the opening. The device is designed so that it can be quickly and easily inserted into and removed from the target aperture of the game board without moving or damaging the game board.

2 Claims, 4 Drawing Sheets

CORNHOLE GAME DIFFICULTY MODIFICATION

STATEMENT REGARDING FEDERALLY SPONSORED RESEARCH OR DEVELOPMENT

This invention was not made by an agency of the United States Government nor under a contract with an agency of the United States Government.

CROSS REFERENCE TO RELATED APPLICATIONS

Provisional Patent Application No. 61/855,300
Filing Date: May 13, 2013
Relationship: Provisional application was for the same invention
Provisional Patent Application No. 61/959,407
Filing Date: Aug. 23, 2013
Relationship: Provisional application was the celebratory sound addition of the invention

PARTIES TO JOINT RESEARCH AGREEMENT

Not Applicable.

REFERENCE TO SEQUENCE LISTING

Not Applicable.

BACKGROUND OF THE INVENTION

Whether it is called corn toss, soft horseshoes, bean bag toss or tailgate toss, the lawn game cornhole is increasing in popularity across the United States. There are numerous associations and clubs for the game including the American Cornhole Association (www.playcornhole.org), the American Cornhole Organization (www.americancornhole.com), the Central Alabama Cornhole Club (www.alabamacornhole-.com), and the Maryland Cornhole Organization, Inc. (www-.marylandcornhole.org). The exact origins of the game are unknown. One version of its history says the game originated in Germany during the fourteenth century and reemerged in Kentucky approximately one hundred years ago. Another version has the game originating in Ohio during the last century. Regardless of its origins, the game appeals to people of all ages.

The game consists of two elevated platforms, typically made of wood, located several feet apart in a level area. The platforms are elevated on an angle with the lower end located typically two to four inches above the ground and the higher end approximately twelve inches above the ground. A standard platform generally measures two feet wide by four feet long with a six inch circular aperture centered horizontally on the board approximately nine inches from the edge of the higher end. In a standard game, the platforms are placed facing each other approximately twenty-seven feet apart. Players take turns tossing a small bag filled with dried beans, corn or other pellets at the platform the farthest from them. Points are awarded for landing the bag on the platform or sending the bag through the target aperture, with a greater number of points awarded for sending the bag through the target aperture. The bag can go through the target aperture by either hitting the target aperture directly or sliding the bag across the board into the aperture. The invention described in this application is intended to provide the players the option of changing the target aperture through which the players desire to send their bag so that the bag can go through the target aperture only by hitting the target aperture directly.

BRIEF SUMMARY OF THE INVENTION

A standard cornhole game board is a flat surface two feet wide by four feet long set on an angle where the lower end is approximately two to four inches above the ground and the higher end approximately twelve inches above the ground. A circular six inch diameter aperture is located in the horizontal center of the board approximately nine inches from the top end upper edge. Players attempt to score points by tossing a bean bag through the target aperture. The bag can go through the target either hitting the target aperture directly or sliding the bag across the game board into the target aperture.

The purpose of the invention is to provide an option for players to change the configuration of the game board's target aperture without permanently modifying the game board. The invention is a device that only allows a tossed bag that directly hits the target aperture to pass through the aperture.

The invention consists of a circular plate ("trapdoor") mounted in a concentrically joined flat disk and ring. The flat disk has a hole in its center which is filled by the trapdoor. The trapdoor is attached to the concentrically joined disk and ring with a spring tension hinge which returns the trapdoor to its original position whenever a bag passes through the target aperture. The disk is tapered such that it is thinnest at its outer edges and thickest at its center. The disk is tapered so as to minimize impediment to a tossed bag sliding across the board towards the target aperture.

The invention can be quickly and easily inserted into and removed from the target aperture of the standard cornhole game board without moving, damaging or otherwise permanently modifying the cornhole game board. The ability to insert and remove the device without moving the game board allows the board to be temporarily modified during a game providing variety in game play.

DETAILED DESCRIPTION OF THE INVENTION

Figure 1:
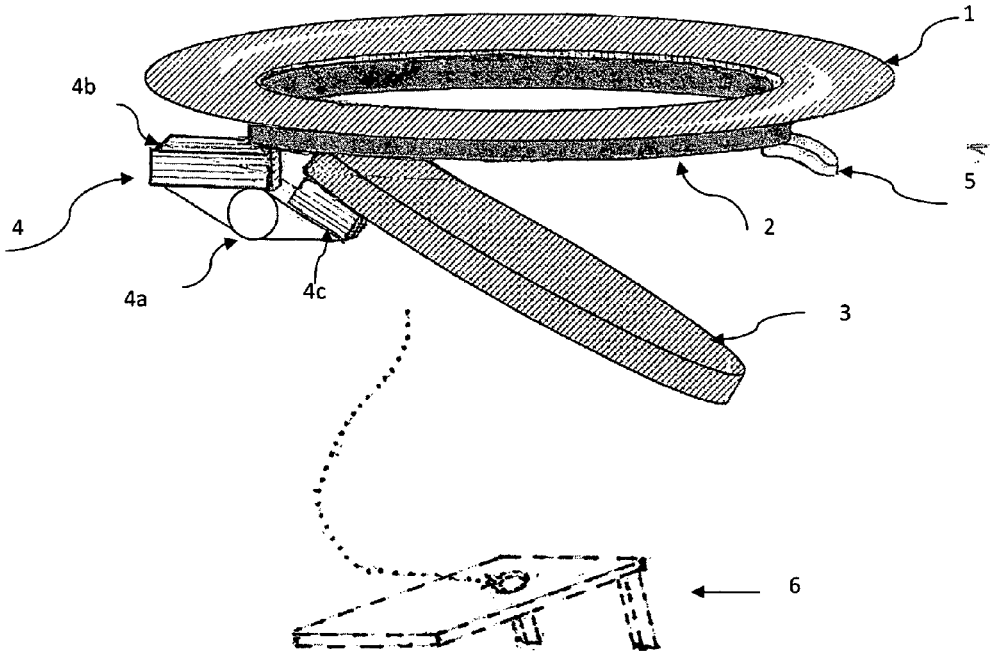
FIG. 1 shows a side view of the invention. A flat circular disk (1) is affixed to a ring (2). The flat disk (1) has a hole in its center which aligns with the open area of the ring (2) to provide the new target aperture for the game. The flat disk is thicker at the center and tapers towards the outer edges; this is to provide minimal obstruction for a bean bag sliding towards the target aperture. A solid circular plate (3) is attached to the ring (2) by means of a spring hinge mechanism (4). A small adjustable fitting (5) is attached to the ring (2). This fitting (5) is used to aid in securing the invention in place when the invention apparatus is inserted into a standard cornhole game board (6). The solid circular plate (3) is shown in a partially open position for clarity. Note that the drawing is not to scale and the cornhole game board (6) is not part of the invention.
Figure 2:
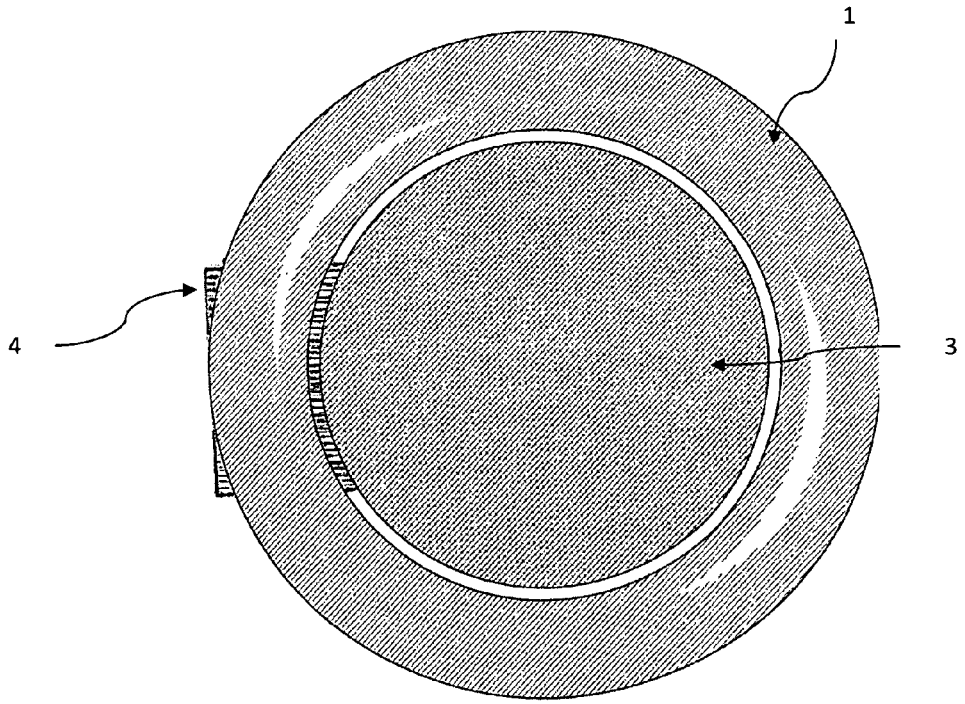
FIG. 2 shows a view of the top of the invention. In this position, the flat circular disk (1), the solid plate (3) and a portion of the spring hinge mechanism (4) are visible. The solid plate (3) is shown in its closed position. Note that the drawing is not to scale.
Figure 3:
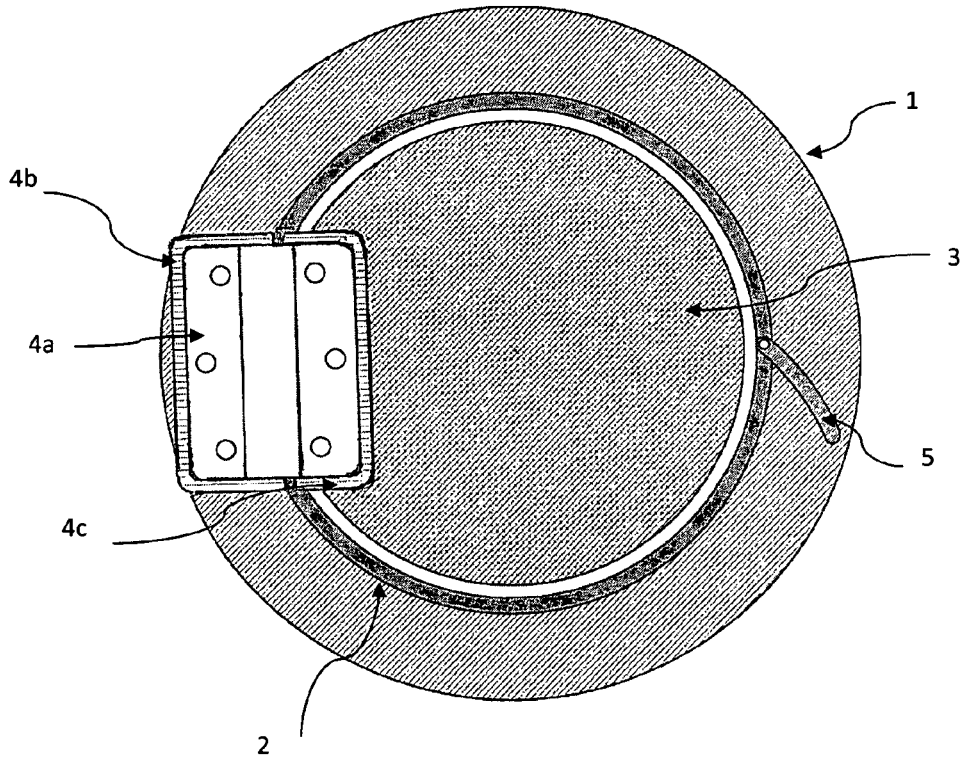
FIG. 3 shows a bottom view of the invention. In this position, the flat circular disk (1), the ring (2), the solid plate (3), the three parts of the spring hinge mechanism (4*a*, 4*b*, 4*c*) and the small adjustable fitting (5) are all visible. Note that the drawing is not to scale.

Cornhole, also known as soft horseshoes, bean bag toss, or tailgate toss, is a popular lawn game played across the country. The game consists to two elevated platforms, typically made of wood, located several feet apart in a level area. The platforms are elevated on an angle with the lower end located typically two to four inches above the ground and the higher end approximately twelve inches above the ground. A standard game platform (game board) measures two feet wide by four feet long with a six inch diameter circular aperture centered horizontally on the board approximately nine inches from the edge of the higher end. Players take turns tossing a small bag filled with dried beans, corn or other pellets at the platform the farthest from them. Points are awarded for landing the bag on the platform or sending the bag through the target aperture, with a greater number of points awarded for sending the bag through the target aperture. The bag can go through the target aperture by either hitting the target aperture directly or sliding the bag across the board into the aperture. The invention described in this application is intended to modify the target aperture through which the players desire to send their bean bag without permanently modifying the game board.

The invention is an adapter designed to be inserted into the game board from the top side (the side that faces the players) and is shown in FIGS. 1 through 4. It consists of a thin circular disk (1) with an outer diameter of eight to nine inches and an inner diameter of five and a half to slightly less than six inches. The thin circular disk (1) is attached to a ring (2). The disk (1) is tapered such that it is thickest near the center and thinnest at the outer edge. This is done to minimize obstruction to a bag sliding across the game board. The ring (2) has an outer diameter of slightly less than six inches and an inner diameter of at least five and a half inches.

The open space of the thin circular disk (1) is filled with a solid circular plate (3), also referred to as the "trapdoor". The trapdoor (3) is attached to the ring (2) by means of a spring hinge mechanism (4). To pass a tossed bag through the cornhole game board's target aperture, a player must toss his bag directly onto the trapdoor (3) to open the trapdoor. A bag sliding across the surface of the game board onto the trap door would not have sufficient force to cause the trapdoor to open. When the trapdoor opens, it allows the bag to fall through the aperture and then the trapdoor returns to its original "closed" position.

Figure 4:
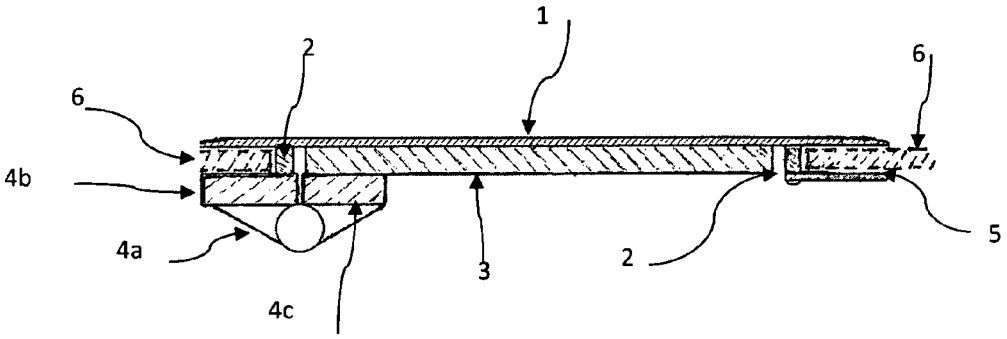
FIG. 4 shows a cross section view of the invention inserted into a cornhole game board (6). In this view, the flat circular disk (1), the ring (2), the solid plate (3), and the three parts of the spring hinge mechanism (4*a*, 4*b*, 4*c*) are all visible. Note that the drawing is not to scale.

The spring hinged mechanism (4) consists of a tension spring hinge (4*a*) and two rectangular solid pieces (4*b* and 4*c*). The trapdoor (3) is directly attached to the smaller of the rectangular solid pieces (4*c*). The larger rectangular solid piece (4*b*) is attached to the ring (2). The two rectangular solid pieces (4*b*, 4*c*) are connected by the tension spring hinge (4*a*). When the invention is inserted into the standard cornhole game board's target aperture, the larger rectangular solid piece (4*b*) and the small adjustable fitting (5) serve to secure the invention apparatus in place as shown in FIG. 4.

The invention apparatus can also include a celebratory sound feature. When a tossed bag impacts the trapdoor with sufficient force to open the trapdoor enough to allow passage of the tossed bag through the target aperture, a celebratory sound is played upon return of the trapdoor to its closed position to herald the score. As cornhole is a game often played at social occasions, such as family reunions, sporting events and outdoor parties, the celebratory sound feature is intended to enhance enjoyment of the game. Devices are currently available in the market place that would allow the retailer or game owner to customize the celebratory sound played.

The materials of construction for the invention can be as varied as the materials used to construct cornhole game boards. As the game boards as typically made of wood, prototypes of the invention were also constructed of wood. However, the invention would not be limited to a wooden construction but could be made of various materials, such as plastic or other organic polymers.

Previous United States Patents for toss games with varying sized target apertures disclose entire games and not a means of modification of an existing commercially available game. U.S. Pat. No. 4,726,591 (Multiple Type Target Game, granted Feb. 23, 1988 to Clyde R. Johnson) describes a toss game with multiple apertures of varying sizes through which the player attempts to throw an object. U.S. Pat. No. 5,765,832 (Changeable Target Game Apparatus, granted Jun. 16, 1998 to Walter M. Huff) discloses a game with a game board (target panel) with a large aperture. A rotating panel with multiple varying sized apertures is affixed to the target panel. The rotating panel can then be turned to align an aperture on the rotating panel to the aperture of the underlying target panel. The invention disclosed in this application is an adapter that can be utilized with the multitude of cornhole game boards already in existence and not the acquisition of an entirely new game.

U.S. Pat. No. 5,478,071 (Visual Assisted Golf Practice Putting Aid, granted Feb. 9, 1995 to Carl A. Barrs, et. al.) discloses an annular insert to be used as a visual target aid for a golf hole. The Barrs patent does not disclose the trapdoor which is an essential part of this invention. U.S. Pat. No. 3,511,506 (Golfing Target, granted May 12, 1970 to Nigel Schollick) for another golf practice aid, includes an electric buzzer to indicate when a flap is moved by a golf ball.

A potential patent classification for this invention is Class 273, Amusement Devices Games; Sub-Class 354, Having means to vary size of projectile receiving target aperture or target opening.

The present invention described above and shown in the accompanying drawings is visualized as the preferred embodiment of the invention. This invention may, however, be embodied in many different forms and should not be construed as limited to the embodiments set forth herein. It will be understood by those skilled in the art that changes in forms and details may be made without departing from the spirit and scope of the present application. It is therefore intended that the present invention not be limited to the exact forms and details described and illustrated herein, but falls within the scope of the appended claims.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

The invention claimed is:

1. An apparatus for insertion into the target aperture of a standard cornhole game board, where said apparatus is comprised of a thin circular disk which has an outer diameter of 8 to 9 inches and an inner diameter of 5.5 to slightly less than 6 inches, and said circular disk is affixed to a ring which has an outer diameter slightly smaller than the standard cornhole gameboard 6 inch diameter target aperture and a minimum inner diameter of 5.5 inches, and a solid circular plate located in the open space of said circular disk and ring and is attached to said ring by means of a spring hinge mechanism and where said solid circular plate will partially move downwards into said disk's and ring's open space and allow passage of a cornhole game bag through said disk and ring when said solid circular plate is impacted by a tossed cornhole game bag with sufficient momentum.

2. The apparatus according to claim 1, where a celebratory sound is played by means of a sound mechanism that is activated when the circular solid plate of claim 1 is moved by the direct impact of a thrown cornhole game bag.

* * * * *